US005899818A

United States Patent [19]

Zider et al.

[11] Patent Number: 5,899,818

[45] Date of Patent: May 4, 1999

[54] TEMPERATURE COMPENSATED GOLF CLUB HEAD

[75] Inventors: Robert B. Zider, Portola Valley; John F. Krumme, Tahoe City, both of Calif.

[73] Assignee: Beta Golf, Inc., Menlo Park, Calif.

[21] Appl. No.: 09/009,765

[22] Filed: Jan. 20, 1998

[51] Int. Cl.[6] ..... A63B 53/04

[52] U.S. Cl. ..... 473/324; 473/331; 473/342

[58] Field of Search ..... 473/324, 329, 473/332, 342, 349, 350, 330, 331

[56] References Cited

U.S. PATENT DOCUMENTS 4,772,112 9/1988 Zider et al. .

4,896,955 1/1990 Zider et al. .

5,176,384 1/1993 Sata et al. .

5,807,189 9/1998 Martin ..... 473/342

*Primary Examiner*—Sebastiano Passaniti

*Attorney, Agent, or Firm*—Baker & Botts

[57] ABSTRACT

A golf club head is provided with an impact surface formed of a shape memory alloy. The shape memory alloy is selected to have a transformation temperature applicable for the range of normal golf playing temperatures, that is in the range between about 0 and 15 degrees C. This selection of the transformation temperature of the impact surface provides an effective variation of the stiffness of the golf club head that compensates for changes of the stiffness of a golf ball with changing temperatures.

11 Claims, 2 Drawing Sheets

TEMPERATURE COMPENSATED GOLF CLUB HEAD

BACKGROUND OF INVENTION

The present invention relates to golf club heads and particularly to golf club heads having impact surface portions fabricated from shape memory alloys.

U.S. Pat. No. 5,176,384 to Sata et al. discloses a golf club head wherein the impact surface of the club head is fabricated from a thermoelastic type martensite transformation alloy, such as a NiTi-based or a copper-based alloy, which is said to have improved carry and directional stability by reason of the use of a thin plate as an impact surface and because of the stress-induced martensite elastic characteristics of the material.

Pending U.S. patent application Ser. No. 08/760,251, the disclosure of which is incorporated herein by reference, discloses a golf club head having an impact surface formed of "pixels", which may comprise shape memory alloy. In one embodiment pixels comprise wires arranged in an array, with wire ends forming the impact surface. Alternately, the pixels may comprise portions of the impact surface that have received different treatment, such as annealing. This prior application indicates that when using a shape memory alloy material, such as NiTi-based alloy, the pixel wires may be in a "superelastic" or "optimized elastic" condition. It is additionally stated that the pixels may be a mixture of superelastic and Martensitic material.

The above discussed disclosures do not address the temperature variation of the mechanical characteristics of shape memory alloys, but assume that the properties remain constant over the usual range of playing temperature, which is about zero to +40 degrees C.

It is generally observed that the performance and impact characteristics of golf balls change with playing temperature. At colder temperatures, for example in the range of zero to 10 degrees C., golf balls tend to have stiffer characteristics. When a ball is struck with a club, the impact will result in vibrations of different frequencies and different amplitudes in the club shaft because of the ball stiffness, which affects the flight of the ball. The stiffness of a conventional club head stays constant throughout the temperature range. At warmer playing temperatures, for example in the range of 30 to 40 degrees C., the ball tends to be more easily deformed upon impact, and different shaft vibrations will occur when the ball is struck by the club head.

The inventors have concluded that it would be desirable to provide a club head having an impact surface whose properties vary with temperature in a manner that complements the temperature variations of the golf ball and allows for a relatively constant interaction between the club head and the ball irrespective of the temperature. Accordingly, at cold temperature the club head impact surface would be softer, to offset the relatively stiffer ball. At higher temperatures, the impact surface would be stiffer, to offset the relatively softer ball. A temperature controlled club head would allow a golfer to have the same feel and club head-ball interaction on cold days and warm days.

In U.S. Pat. Nos. 4,772,112 and 4,896,955 there is discussed the temperature variation of mechanical properties of NiTi based shape memory allows, and particularly the use of the "optimized elastic" properties of the alloy for application to eyeglass frames. In those patents the stated objective was to provide frame components that exhibit elastic properties over a wide temperature range of −20 to +40 degrees C. The material is also capable of exhibiting shape memory characteristics, in addition to elastic characteristics, at the lower temperatures within that range. The object of these patents is to allow bending of an eyeglass frame at different temperatures and allow it to return to a usable shape without permanent deformation.

It is an object of the present invention to provide a golf club head with an impact surface that has different and desirable mechanical characteristics at different playing temperatures, to thereby provide a softer impact associated with the Martensitic phase at lower temperatures and to provide a stiffer impact associated with the austenitic phase at higher temperatures which reduces vibrations and provides a more constant feel for the club.

SUMMARY OF THE INVENTION

In accordance with the invention there is provided a golf club head having temperature variable impact properties. The golf club head includes an impact surface at least partially fabricated from a shape memory alloy having a transformation temperature, as defined herein, in the range of approximately 0 to 15 degrees C. The impact surface thereby behaves substantially elastically at higher playing temperatures and has softer impact characteristics at lower playing temperatures. In one embodiment the impact surface is a shape memory alloy in an at least a partially work-hardened condition. The impact surface exhibits stiffer characteristics at the higher playing temperatures and relatively less stiff characteristics at lower playing temperatures. The impact surface can also exhibit a combination of partial elastic behavior (less stiff) and heat recoverable shape memory at the lower playing temperatures.

In a variation, a golf club head may comprise a shape memory alloy in an annealed condition so that the impact surface exhibits high elastic behavior at the higher playing temperatures and heat recoverable shape memory behavior at the lower playing temperatures. The impact surface may be formed as a thin plate of shape memory alloy. Alternatively, the impact surface may be fabricated using first and second zones distributed on the impact surface, the zones being of material with residual work hardening or annealed material in accordance with a predetermined distribution. The impact surface may be fabricated from wire segments of shape memory alloy which are arranged in parallel configuration having wire segment ends forming the impact surface.

For a better understanding of the present invention, together with other and further objects thereof, reference is made to the following description, taken in conjunction with the accompanying drawings and its scope will be pointed out in the appended claims.

DESCRIPTION OF THE PREFERRED EMBODIMENTS

A shape memory alloy, such as nickel-titanium based alloy, can be used as part of a golf club head in order to stabilize the feel of the club. The shape memory alloy, which is selected to have an appropriate transformation temperature, when properly conditioned will become stiffer at higher temperatures and less stiff at colder temperatures. This type of club head will allow the head stiffness to compensate for the change in the golf ball's characteristics at different temperatures. Golf balls get stiffer at cold temperatures and softer at higher temperatures.

Figure 1:
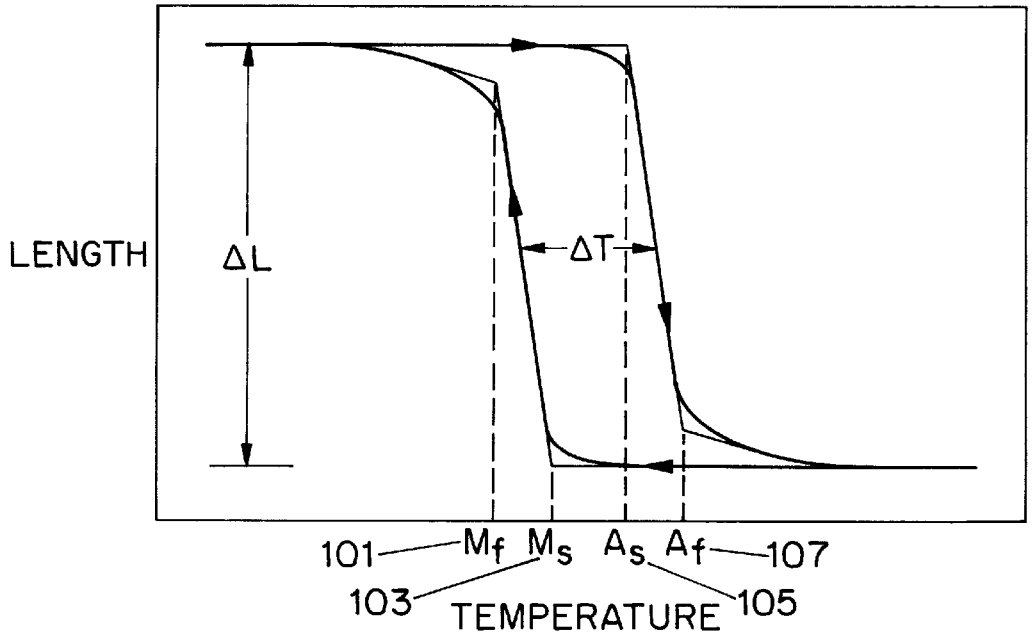
FIG. 1 represents the specimen length versus the temperature in a constant load test of the stress-strain behavior of a NiTi based shape memory alloy in the annealed condition, respectively above and below the transformation temperature.

Transformation temperatures are those temperatures at which shape memory alloys change from the higher temperature Austenite to the lower temperature Martensite or vice versa. There are numerous ways of determining transformation temperatures. One way is to use a constant load test. It is straightforward to apply a load to the alloy and monitor its deformation and shape recovery simultaneously with temperature as the material is cooled and heated through the transformation range. For example, the elongation and contraction of a shape memory wire under constant tensile loading is shown in FIG. 1, as the temperature is lowered and subsequently raised. Generally, the specific load that the material will see in the actual application is used for the test to simulate the conditions in practice. The temperature points noted are ones frequently used to describe the behavior of a particular alloy. $M_s$ point 103 is the temperature where the Martensite starts to form on cooling and $M_f$ point 101 is the temperature at which the material becomes fully Martensitic because of cooling. $A_s$ point 105 is the temperature which marks the start of Austenite formation on heating, while $A_f$ point 107 identifies the temperature whereat the transformation to Austenite is completed. This type of test is generally used for applications which utilize the shape memory effect in NiTi.

The transformation temperatures depend on the particular alloy and its working and annealing history, and are stress dependent parameters, i.e., the transformation temperatures will be different under different loads. In order to determine the transformation temperatures at zero stress, a curve such as that shown in FIG. I must be obtained at two or more stress levels. The particular transformation point of interest can then be extrapolated to zero stress.

As used in this application the term "transformation temperature" refers to the arithmetic average of the four transformation temperatures $M_s$, $M_f$, $A_s$ and $A_f$ In the temperature range of approximately 15 degrees above the transformation temperature, shape memory alloys in the annealed condition exhibit high elasticity.

Figure 2:
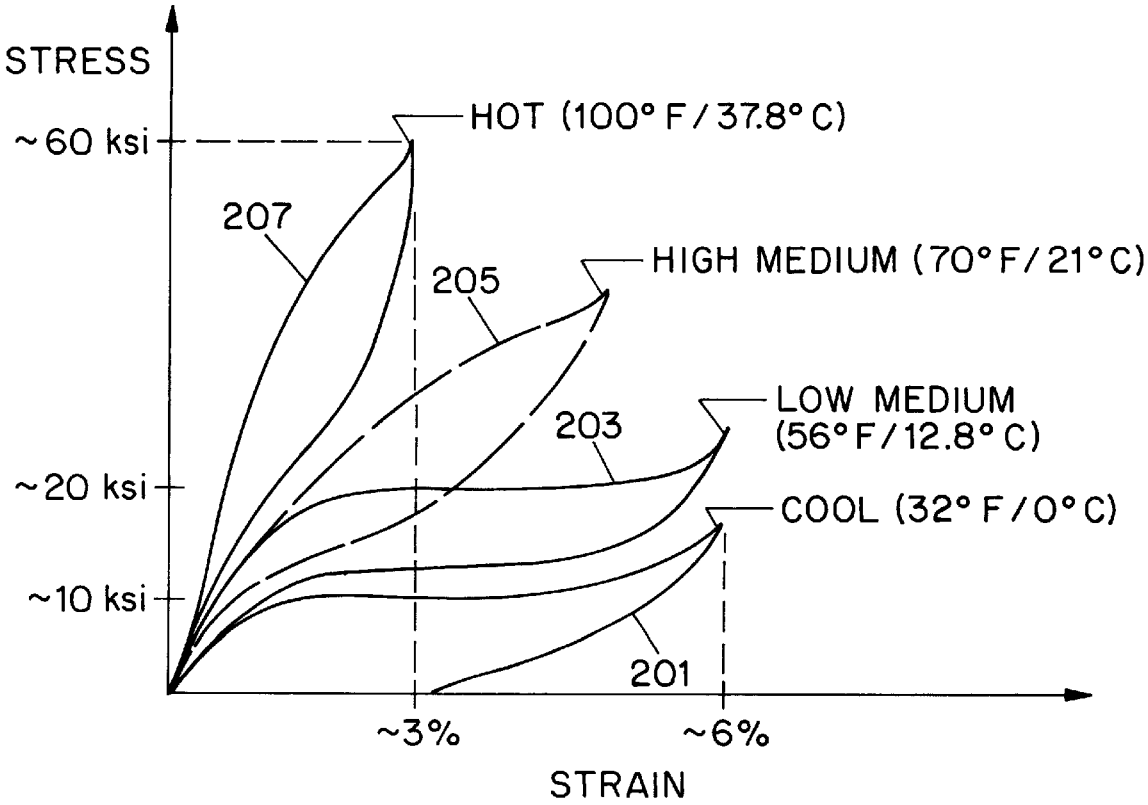
FIG. 2 is a graph showing the stress-strain behavior of a NiTi based alloy at different temperatures.

FIG. 2 shows an example of a stress strain curve for a NiTi golf club impact surface at different temperatures. In one example, the NiTi surface is made of 50.6 At % Ni and 49.4 At % Ti. The material is then work-hardened. The material is finally heat treated at 600 degrees C. for thirty minutes which removes most of the work hardening.

FIG. 2 shows that for a given strain on the NiTi alloy, the stress will be different at different temperatures. A higher stress level means the material is stiffer and does not have a lot of "give." As shown in the graph when the temperature is 32 degrees F. (0 degrees C.), the material exhibits a near constant stress level represented by curve 201 showing that the material is more flexible. This flexibility compensates for the hardness of the golf ball in cold weather. Curve 201 also shows that upon removal of stress there is only partial elastic recovery. The material returns to its original shape, however, when heated above the transformation temperature to cause it to revert to the Austenite phase. This phenomena is called heat recoverable shape memory.

Stress-strain curve 203 shows the material having higher stress for the same strain amount. This shows that the material at 56 degrees F. (13 degrees C.) is stiffer than at 32 degrees F. Stress-strain curve 205 representing behavior at of 70° F. (21° C.) shows a still higher stress level at similar strain amounts, and is therefore stiffer than at colder temperatures. Thus a golf ball which is not as hard in hot temperatures will be compensated for by causing the club face to be stiffer. Stress-strain curve 207 shows the NiTi material at 100 degrees F. (38 degrees C.). In the case of desert golf or warmer climates, this condition can occur often. The curve shows a high level of stress at low strain levels and indicates that the material is very stiff at the high temperature.

Since golf is an outdoor game, usually played in spring through fall weather, the outdoor temperatures usually encountered might be considered to vary between extremes of zero degrees C., representing a very cold spring or fall morning, to about 40 degrees C., representing warm afternoon temperatures in hot areas of the country, such as desert areas. Accordingly, the inventors have concluded that it would be advantageous to select the transformation temperature of a material for a golf club impact surface to be at the lower end of the playing temperature range, that is from about 0 to about 15 degrees C., to thereby provide a highly elastic but stiffer golf club impact surface at temperatures above the transformation temperature, representing the higher playing temperature range, such as between 20 and 40 degrees, or more preferably between 25 and 40 degrees C. A softer material with a stress strain characteristics for the lower temperatures as shown in FIG. 2 will be realized at the lower temperature range at which playing might occur, for example between zero and 20 degrees C., more preferably between zero and 15 degrees C.

This variation in stiffness of the impact surface of a golf club head effectively compensates for changes which naturally occur in the stiffness of a golf ball. At lower temperatures, golfers experience a "ringing" of a golf club shaft which is the result of the fact that the golf ball has become harder. By providing a material which has decreased stiffness for the golf club impact surface at low temperature, the ring or vibration in the golf club shaft can be reduced, giving the golfer a more comfortable feel for the impact and otherwise improving and elongating the impact time between the golf ball and the golf club head. At higher temperatures, the golf club head impact surface is stiffer, while the golf ball itself is softer, so that a relative uniformity of impact time between the golf club head the golf ball is achieved, providing the golfer with relatively uniform performance in using the club as play temperatures vary.

Figure 3:
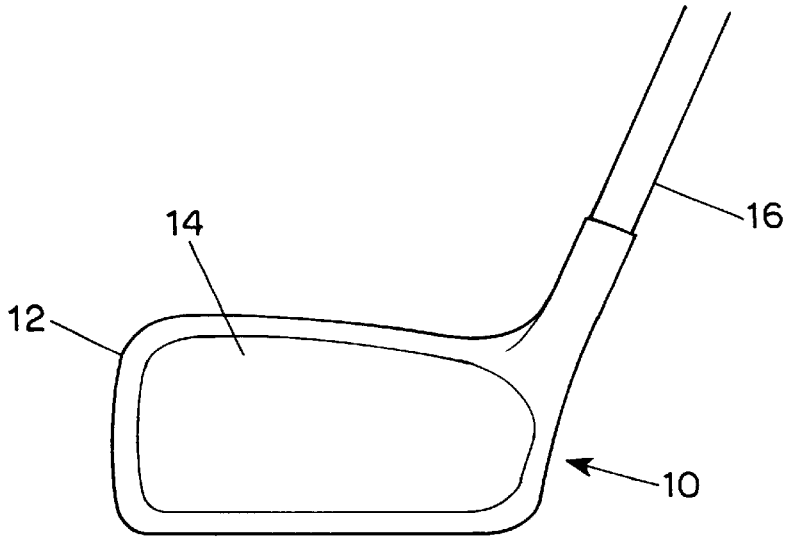
FIG. 3 is a front view of a golf club head in accordance with the present invention.
Figure 4:
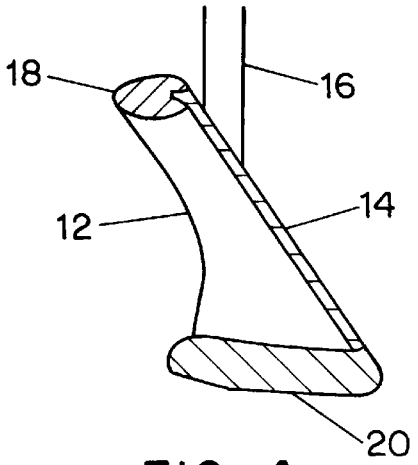
FIG. 4 is a cross-sectional view of the FIG. 3 golf club head.

FIGS. 3, 4, 5 and 6 depict specific exemplary constructions which can be used to provide a golf club head with an impact surface having a shape memory alloy with properties in accordance with the present invention. In particular FIG. 3 illustrates a frontal view of a golf club head 10 which is connected to a shaft 16. The golf club head 10 includes a body portion 12 and an impact surface 14. A cross-sectional view of the FIG. 3 golf club head, is shown in FIG. 4, wherein impact surface 14 is formed of a plate of shape memory alloy material, such as nickel-titanium shape memory alloy or a ternary or several addition nickel-titanium based shape memory alloy. Alternate material includes copper based shape memory alloys and including single crystal copper based shape memory alloys. U.S. Pat. No. 5,176,384 proposes that the impact surface 14 comprise a thin plate of shape memory alloy material which exhibits stress-induced martensite elasticity. Accordingly, one following the teachings of that patent, would select a material to have a stress-induced martensite elasticity over the entire temperature range of use, and accordingly $M_s$ below the lower range of normal use, in particular below zero degrees C.

Impact surface 14 is formed as a thin plate which is embedded within a recess in golf club head 12 between blade 18 and sole 20. In accordance with the present invention the plate 14 is fabricated from a shape memory alloy, which has a transformation temperature of approximately 0 to 20 degrees C., preferably 0 to 15 degrees C., to cause a transformation between the stiffer elastic behavior represented by curve 207 in FIG. 2 at the higher end of the normal playing range of temperatures, and a softer, partially elastic behavior represented by curve 201 of FIG. 2, which is exhibited at the lower end of the playing range of temperatures. Accordingly the golf club head of FIGS. 3 and 4 has a softer impact characteristics at lower playing temperatures than at higher playing temperatures.

Figure 6:
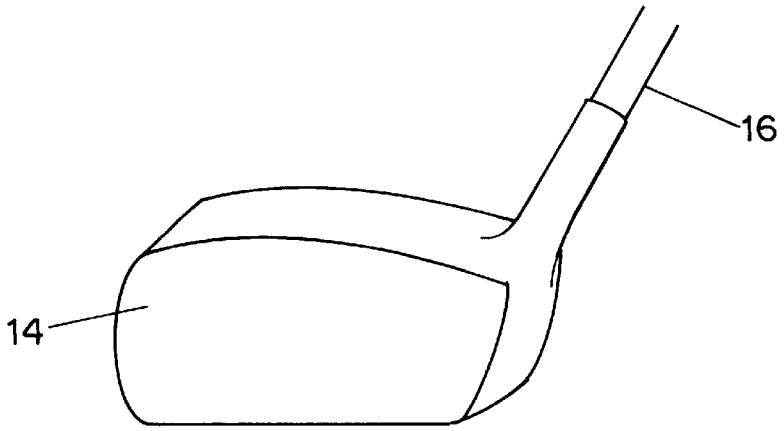
FIG. 6 is a front view of an another alternate embodiment of a golf club head.

FIG. 6 illustrates a golf club head 10 which is made up substantially of a shape memory alloy having similar stress-strain properties as the shape memory alloy of the FIG. 3 and 3 impact plate 14. In this case, the plate would be integral with the rest of the head.

In an alternative embodiment, different characteristics of the shape memory alloy caused by different amounts of work hardening and annealing can be used in connection with the impact surface 14 of the golf club head of FIGS. 2 and 3. In either the annealed or work-hardened shape memory alloy impact surface, the impact surface 14 may be adjusted in thickness to provide the correct impact modulus.

Figure 5:
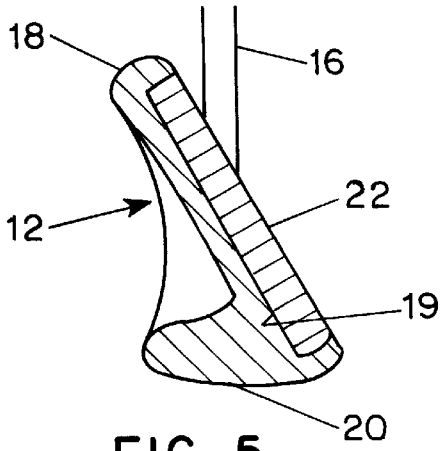
FIG. 5 is a cross-sectional view of an alternate golf club head in accordance with the present invention.

A further embodiment of the invention is depicted in the cross-sectional view of FIG. 5. This figure represents a golf club head having an impact surface formed using the pixel technique described in U.S. patent application Ser. No. 08/760,251, as referenced above. In this case the impact surface 20 is formed using a material with individual impact zones formed, for example, by using individual wire segments having their ends forming the outer impact surface or by using varying treatment conditions for zones of a single plate material, all as described in the aforementioned copending application, the disclosure of which is incorporated herein by reference. In connection with treatment of a single plate by varying treatment, the use of heat treatment to soften some pixel areas of the impact surface as compared to others, may be used as described in the copending application.

In addition to the variation in treatment of the materials as described in the copending application, the construction shown in FIG. 5 can be advantageously used to provide an impact surface 20 having relatively uniform impact conditions over the entire surface area but having a variation in impact characteristics with temperature as represented by the stress strain characteristics of FIG. 2. In either case the material forming the impact surface and the impact zones, or the material forming the wires used to form an impact surface with wire segments ends, would be material having a transformation temperature preferably in the range of 0 to 15 degrees C., as described.

While there have been described what I believe to be the preferred embodiments of the present invention, those skilled in the art will recognize that other and further variations may be made thereto without departing from the spirit of the present invention and it is intended to claim all such changes and modifications as fall within the true scope of the invention.

I claim:

1. A golf club head for striking a golf ball and having temperature variable impact properties, said club head comprising an impact surface or portion thereof fabricated from a shape memory alloy having a transformation temperature in the range of 0 to 15 degree C., said impact surface having stiff, substantially elastic impact characteristics at playing temperatures higher than said transformation temperature and having softer impact characteristics at playing temperatures lower than said transformation temperature; whereby the variation in stiffness of the impact surface of the golf club head when striking a golf ball over a range of playing temperatures above and below said transformation temperature compensates for changes in the stiffness of a golf ball due to changes in the range of playing temperatures.

2. The golf club head as specified in claim 1 wherein said impact surface comprises a shape memory alloy in at least a partially work-hardened pseudoelastic condition and exhibiting a first stiffer elastic behavior at said higher playing temperatures and a second softer partially elastic behavior at said lower playing temperatures.

3. The golf club head as specified in claim 2 wherein said impact surface exhibits a combination of said softer partially elastic behavior and heat recoverable shape memory behavior at said lower playing temperatures.

4. The golf club head as specified in claim 1 wherein said impact surface comprises a shape memory alloy in an annealed condition, said impact surface exhibiting elastic behavior at said higher playing temperatures and heat recoverable shape memory behavior at said lower playing temperatures.

5. A golf club head for striking a golf ball and comprising a head body having an impact surface, said surface comprising a thin plate formed of shape memory alloy having a transformation temperature in the range of 0 to 15 degrees C., whereby said plate has stiff, substantially-elastic behavior at playing temperatures higher than said transformation temperature and has softer impact characteristics at playing temperatures lower than said transformation temperature whereby the variation in stiffness of the impact surface of the golf club head when striking a golf ball over a range of playing temperatures above and below said transformation temperature compensates for changes in the stiffness of a golf ball due to changes in the range of playing temperatures.

6. The golf club head as specified in claim 5 wherein said impact surface comprises a shape memory alloy in at least a partially work-hardened condition and exhibiting stiff elastic behavior at said higher playing temperatures and softer, less elastic behavior at said lower playing temperatures.

7. The golf club head as specified in claim 6 wherein said impact surface exhibits a combination of said less elastic behavior and heat recoverable shape memory behavior at said lower playing temperatures.

8. The golf club head as specified in claim 5 wherein said impact surface comprises a shape memory alloy in an annealed condition, said impact surface exhibiting elastic behavior at said higher playing temperatures and heat recoverable shape memory behavior at said lower playing temperatures.

9. A golf club head for striking a golf ball and having temperature variable impact properties comprising an impact surface fabricated from a shape memory alloy having a transformation temperature in the range of 0 to 15 degrees C., said impact surface including a plurality of first and second zones across said impact surface, one or more of said first zones being surrounded by one or more of said second zones, one of said first or second zones comprising material with residual work hardening and the other of said zones comprising material in an annealed condition, said impact surface having substantially elastic impact characteristics at playing temperatures higher than said temperature range and having softer impact characteristics at playing temperatures lower than said transformation temperature, whereby the variation in stiffness of the impact surface of the golf club head when striking a golf ball over a range of playing temperatures above and below said transformation temperature compensates for changes in the stiffness of a golf ball due to changes in the range of playing temperatures.

10. A golf club head for striking a golf ball and having a temperature variable impact surface comprising an impact surface fabricated from shape memory alloy wire segments, said segments being arranged in parallel configuration and having wire segment ends forming said impact surface, said shape memory alloy having a transformation temperature in the range of 0 to 15 degrees C. said impact surface having substantially elastic impact characteristics at playing temperatures higher than said transformation temperature and having softer impact characteristics at playing temperatures lower than said transformation temperature, whereby the variation in stiffness of the impact surface of the golf club head when striking a golf ball over a range of playing temperatures above and below said transformation temperature compensates for changes in the stiffness of a golf ball due to changes in the range of playing temperatures.

11. A golf club head as specified in claim 10 wherein selected ones of said wire segments have different work hardening characteristics than others of said wire segments.

* * * * *